US008091978B2

(12) United States Patent
Yearout et al.

(10) Patent No.: US 8,091,978 B2
(45) Date of Patent: Jan. 10, 2012

(54) INK COLLECTION FOR PRINTERS

(75) Inventors: Russell P. Yearout, Brush Praire, WA (US); Steve A. O'Hara, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 381 days.

(21) Appl. No.: 12/371,225

(22) Filed: Feb. 13, 2009

(65) Prior Publication Data

US 2010/0207993 A1 Aug. 19, 2010

(51) Int. Cl.
*B41J 2/165* (2006.01)

(52) U.S. Cl. ..... 347/33

(58) Field of Classification Search ..... 347/22, 347/25, 28, 33
See application file for complete search history.

(56) References Cited

U.S. PATENT DOCUMENTS

| | | | | |
|---|---|---|---|---|
| 4,965,596 | A | 10/1990 | Nagoshi et al. | |
| 5,589,865 | A | 12/1996 | Beeson | |
| 6,213,017 | B1 | 4/2001 | Schafer et al. | |
| 6,820,961 | B2 | 11/2004 | Johnson | |
| 6,932,455 | B2 * | 8/2005 | Monclus et al. | 347/22 |
| 7,124,682 | B2 * | 10/2006 | Aoki | 101/155 |
| 7,188,927 | B2 | 3/2007 | Anderson, Jr. et al. | |

* cited by examiner

*Primary Examiner* — An Do

(57) ABSTRACT

An exemplary printer system may include a print head for dispensing ink during a printing operation. A roller is positioned beneath a platen to collect excess ink from the print head. A scraper is positioned against the roller to remove ink from the roller.

20 Claims, 3 Drawing Sheets

INK COLLECTION FOR PRINTERS

BACKGROUND

Color printers have become increasingly more commonplace with advances in printing technologies. High-quality color printers are readily commercially available in a variety of sizes and prices ranging from portable and desktop printers for use at home or at the office, to large commercial-grade printers. Traditionally, printers were, used primarily for printing text documents. Today, however, color printers are available and are routinely used to print complex images, such as digital photographs. Often it is difficult to distinguish color printed images from developed film photographs.

It is often desirable to deposit ink at the very edge of the paper (or other print medium), for example in Page Wide Array (PWA) printing. In order to do so, PWA printers continue to deposit ink during the printing process even as the edge of the print medium is moved out from under the print head, causing an overspray. Even if the printing operation does not print to the edge of the print medium, ink may still be ejected in between pages in order to maintain the ink nozzles by preventing ink from ring in the nozzles.

In either case, excess ink may buildup on the platen. If allowed to accumulate, ink residue may be smeared onto the print medium during subsequent print jobs.

PWA printers are also commonly equipped with a vacuum to maintain the print medium flat against the platen during the printing process. The vacuum is typically applied beneath the platen, and accordingly, the vacuum also forms an aerosol from the excess ink. In aerosol form, the ink residue may travel even deeper into the printer housing, contaminating other printer components. For example, ink may build up on the vacuum filter and thus increase the frequency with which the vacuum filter needs to be changed.

DETAILED DESCRIPTION

Exemplary systems and methods for ink collection and aerosol management are disclosed which may be implemented in printer systems, such as Page Wide Array (PWA) printers. In an exemplary embodiment, the systems and methods reduce ink build up and accumulation of overspray during the print procedure.

The systems and methods disclosed herein may reduce the impact on the printer environment, reduce operating costs, and increase overall customer satisfaction with printer systems. In addition to providing better print quality by reducing smearing on print jobs, ink collection and aerosol management may also reduce the need for service calls to have the printer cleaned as well as technician visits to have components repaired or replaced.

Figure 1:
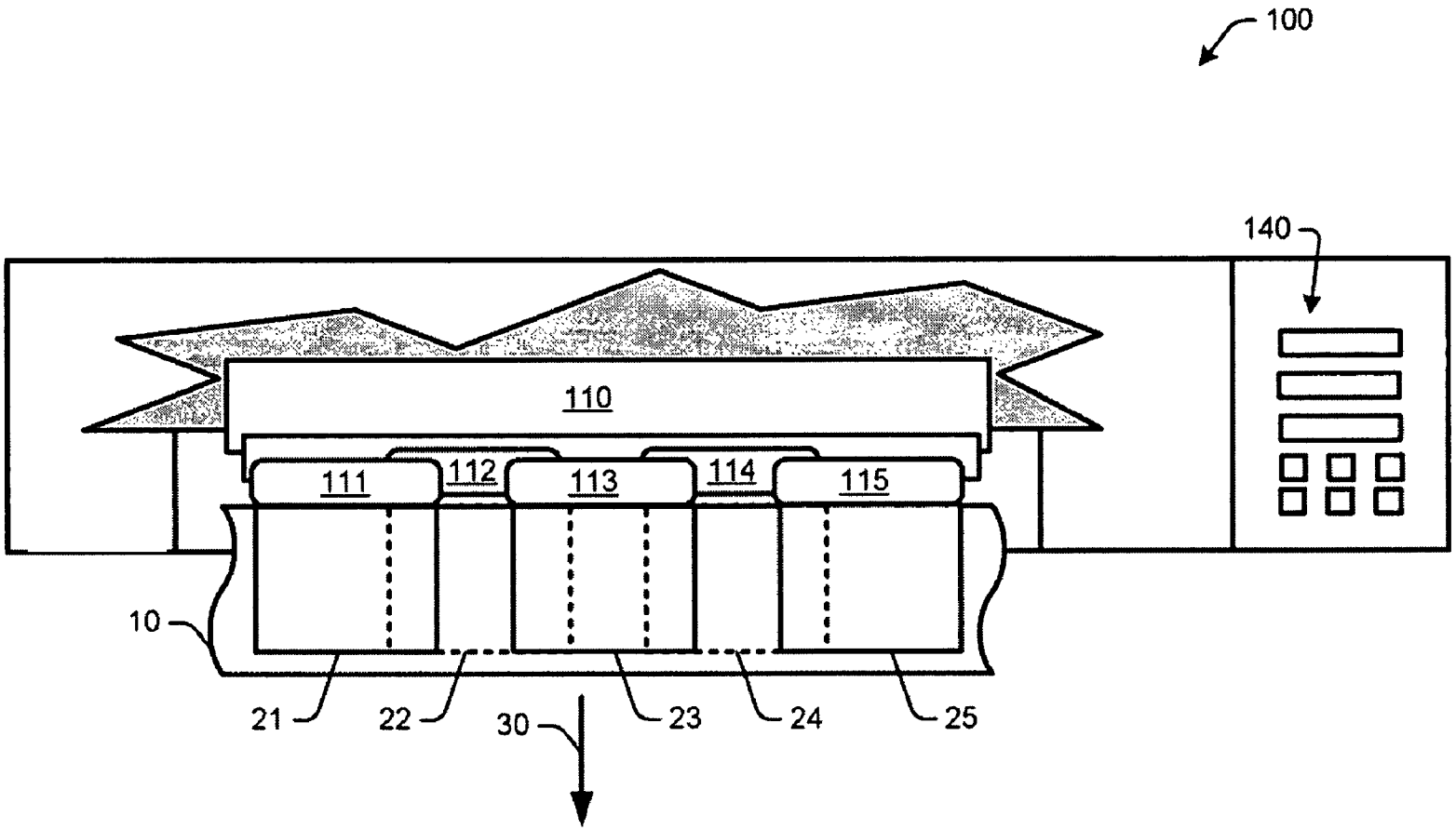
FIG. 1 illustrates an exemplary page wide array (PWA) printer which may implement ink collection and aerosol management.

FIG. 1 illustrates an exemplary printer system 100 which may implement ink collection and aerosol management. Exemplary printer system 100 may be a PWA color inkjet printer. The ink collection and aerosol management techniques described herein may also be implemented for other suitable printers now known or later developed.

Printer system 100 may include one or more print heads such as print head 110 provided over a print media 10 (e.g., paper) as the print media 10 is fed through the printer (e.g., in the directions illustrated by arrow 30). Print head 110 may be a multi-die print head having print dies 111-115. It is noted, of course, that print head 110 is not limited to any particular number or arrangement of print dies. The configuration shown in FIG. 1 is merely illustrative of an exemplary embodiment.

Optionally, an external control panel 140 may be provided for input/output by a user. Also optionally, the printer system 100 may be operatively associated with an external device (not shown), such as a computer or other electronic device for input/output by the device.

An internal control system (not shown) may be operatively associated with a driving mechanism (not shown) to move a feed mechanism (not shown) to move the print media 10 adjacent the print head 110 in the direction illustrated by arrow 30. The controller may also be operatively associated with one or more ink cartridges fluidically connected to the print dies 111-115 to control the flow of ink for transfer on the print media 10 (e.g., as Illustrated in FIG. 1 by image portions 21-25 corresponding to print dies 111-115, respectively, on print media 10).

The amount of ink from each print die 111-115 must be carefully controlled in order to print an image having a consistent print quality across the print media. This is typically accomplished using a control system for the print head. Exemplary control systems may include a number of subsystems. The subsystems may be implemented as program code (e.g., firmware or software) and/or as logic components. Such control systems such as may be implemented in a typical PWA printer are well understood in the printing arts and therefore the control system is not discussed further herein.

Before continuing, it is noted that the systems and methods described herein are not limited to the printer system 100 described above with reference to FIG. 1. Other printer systems which may benefit from implementation of the described systems and methods will be readily appreciated by those having ordinary skill in the art after becoming familiar with the teachings herein.

Figure 2:
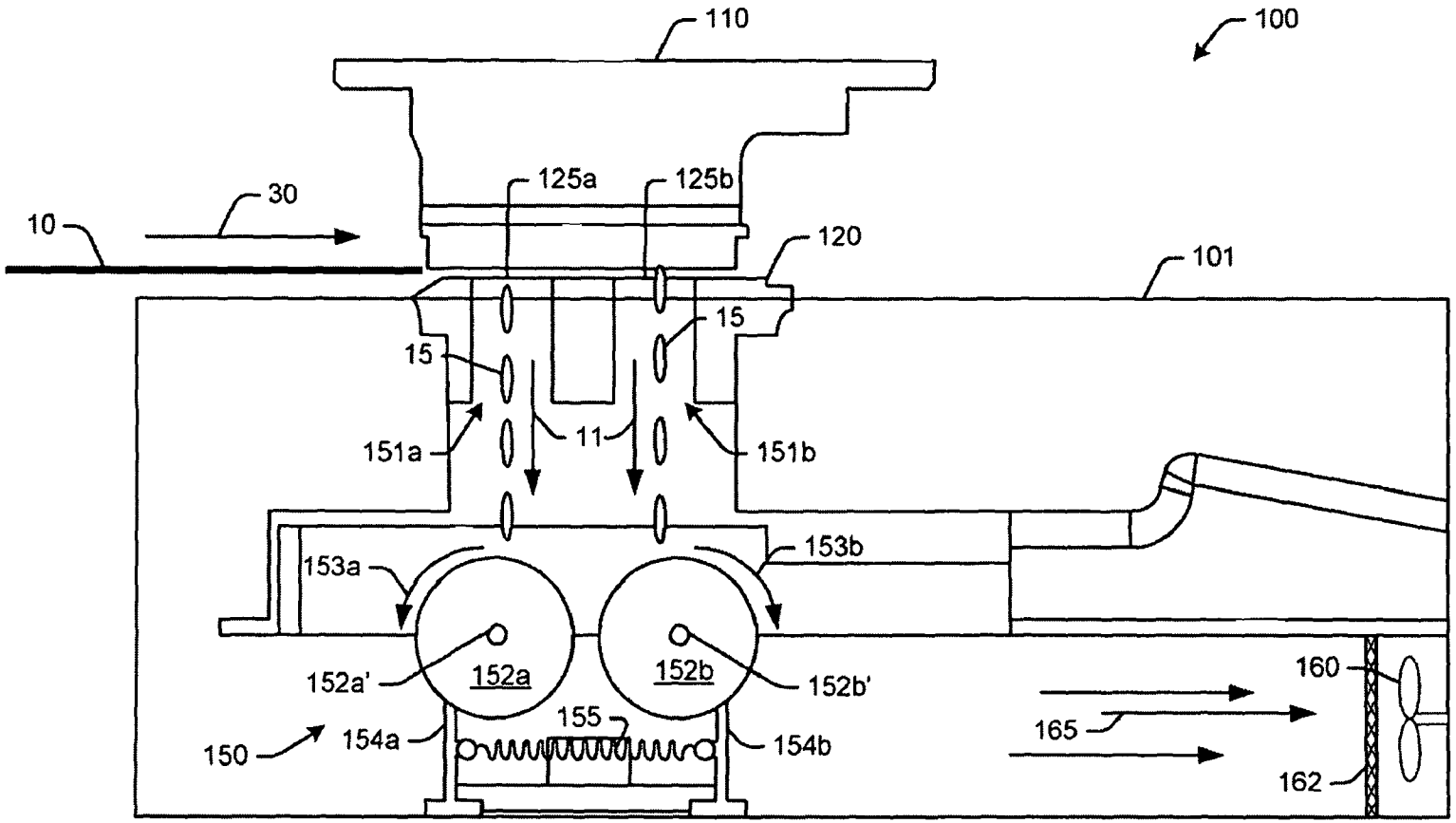
FIG. 2 is a partial side view of a PWA printer showing one embodiment of an ink collection system.

FIG. 2 is a partial side view of a PWA printer showing one embodiment of an ink collection system. The printer system 100 may be configured to receive a print medium 10 between the print head 110 and a platen 120. When the print medium 10 is fully positioned beneath the print head 110, substantially all of the ink is deposited onto the print medium 10. However, in order to deposit ink up to the very edge of the print medium 10, it is necessary to begin depositing ink before the print medium 10 is fully positioned beneath print head 110, and to continue depositing ink as the print medium 10 is removed from beneath the print head 110. Accordingly, excess ink may be collected through one or more openings 125*a* and 125*b* formed through the platen 120.

An ink collection system 150 may be provided within the housing of the printer system 100. In an exemplary embodiment, the ink collection system 150 includes one or more chimneys 151*a* and 151*b* positioned beneath the opening(s) 125 in the platen 120 so that excess ink 15 is directed onto one or more rollers 152*a* and 152*b*. In the example shown in FIG. 2, dual rollers are configured beneath the offset openings in the platen 120 (see, e.g., the offset openings 125*a* and 125*b* in the platen 120 shown in more detail in FIG. 3).

The excess ink 15 may by directed onto the roller(s) 152*a* and 152*b* by fall in the direction of arrows 11 under the force of gravity and/or being pulled under a vacuum created by the blower device 160.

Before continuing, it should be noted that the excess ink is shown in FIG. 2 as exaggerated droplets of ink 15 and is not shown to scale. The excess ink 15 is shown in exaggerated form for purposes of illustration only. In reality, the excess ink 15 is typically a large number of very small droplets, relative to the size of the printer components shown in FIG. 2.

It should also be noted that an end view of the roller(s) 152*a* and 152*b* is visible in FIG. 2. The rollers 152*a* and 152*b* may be configured as cylinders to provide a sufficient surface area for collecting the excess ink 15. In any event, the rollers 152*a* and 152*b* may be rotated about axis 152*a*' and 152*b*' (e.g., in the direction shown by arrows 153*a* and 153*b*, respectively) during operation to form a thin film of ink on the surface of the rollers 152*a* and 152*b*. Although not limited to any particular direction of rotation, it is noted that rotating the rollers 152*a* and 152 in opposite directions enable more effective management of the ink by moving the ink on the rollers away from each others. The rollers 152*a* and 152*b* thus gather the excess ink 15 and move the thin film of ink toward one or more scrapers 154*a* and 154*b*, respectively.

Scraper(s) 154*a* and 154*b* may be positioned against the surface of the rollers 152*a*, and 152*b*. In an exemplary embodiment, one or more spring 155 may provide additional tension for the scrapers 154*a* and 154*b*, e.g., by pulling the scrapers 154*a* and 154*b* against the surface of the rollers 152*a* and 152*b* as the rollers rotate. Accordingly, the scrapers 154*a* and 154*b* remove the excess ink 15 from the rollers 152*a* and 152*b*.

The rollers 152*a* and 152*b* may be rotated continuously or at predefined times (e.g., intervals which correspond to the time it takes to print a page). In addition, the rollers 152*a* and 152*b* may be rotated automatically (e.g., using a drive system) or manually.

The ink collection system 150 effectively removes the excess ink 15 in a controlled manner for collection within the housing 101 of the printer system 100 for recycling, reuse, or disposal. Thus, the excess ink 15 contaminating other parts (e.g., vacuum filter 162 due to airflow 165) of the printer system 100 is reduced or altogether eliminated.

Excess ink 15 may also be removed prior to forming an aerosol (e.g., which may be caused by ink being entrained in airflow 165, as was discussed above) by implementing an aerosol management system at or near the printing surface. In an exemplary embodiment, an aerosol management system is implemented in the platen 120 so that excess ink only travels about 20 mm before being collected by rollers 152*a* and 152*b*.

Figure 3:
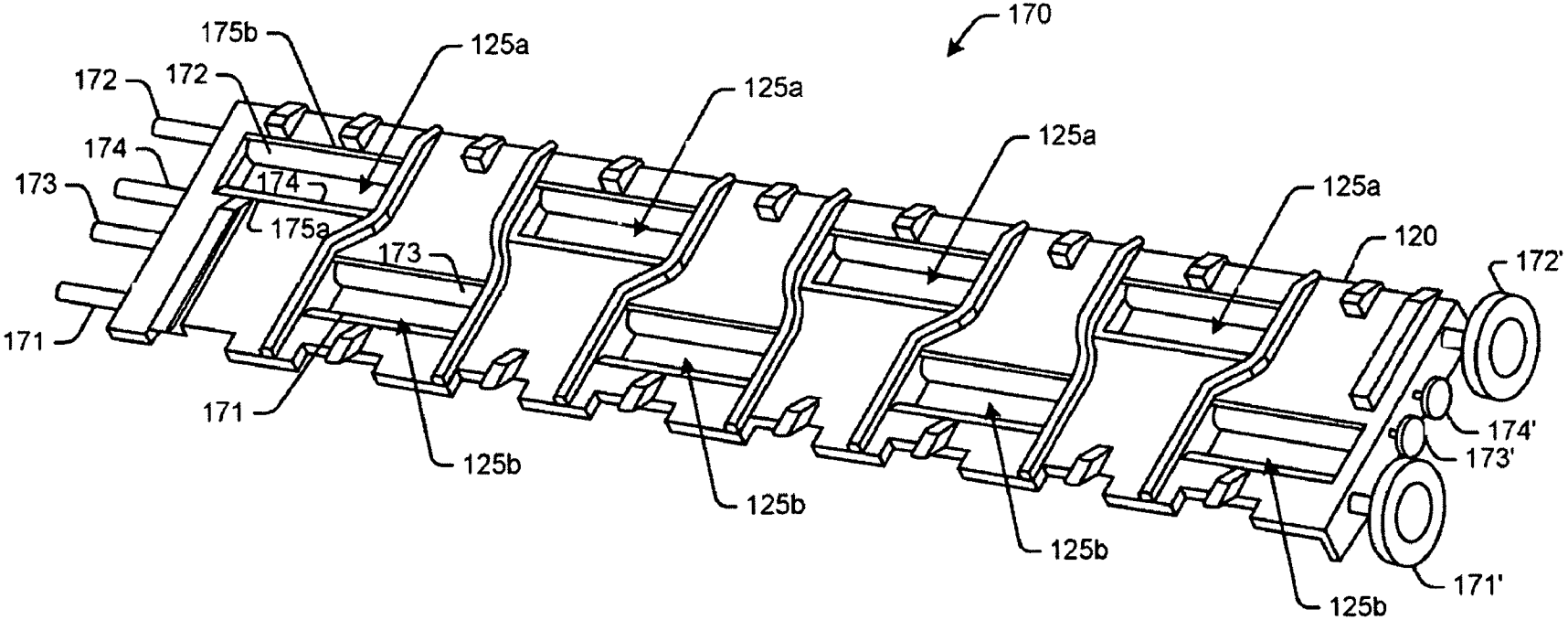
FIG. 3 is an isometric view of an exemplary platen for a PWA printer showing one embodiment of an aerosol management system.

FIG. 3 is an isometric view of an exemplary platen 120 for a PWA printer e.g., printer system 100 shown in FIGS. 1 and 2) showing one embodiment of an aerosol management system 170. Aerosol management system 170 may include one or more rollers in the platen 120 and corresponding scrapers.

In FIG. 3, four separate rollers 171-174 are shown extending the entire length of the platen 120. Corresponding scrapers are also shown in FIG. 3 as the scrapers may be provided as part of or integral to each opening. For example, edges 175*a* and 175*b* of the opening 125*a* may serve as scrapers as shown in the upper left-hand corner of FIG. 3. That is, scraper 175*a* is provided for roller 174 and scraper 175*b* is provided for roller 172 in service window 125*a*. Although not labeled in each of the openings shown in FIG. 3, similar configurations can be seen for each of the openings.

In an exemplary embodiment, a drive system (not shown) may engage the rollers 171-174 on corresponding gear heads 171'-174' to rotate the rollers 171-174 during operation. Excess ink 10 may be collected on the rollers 171-174 and removed by the scrapers similarly to that described above for the ink collection system 150 (FIG. 2). Providing the aerosol management system 170 near the ink delivery reduces the amount of excess ink 10 that becomes entrained in the vacuum generated by blower 160 (FIG. 2), and therefore reduces the amount of aerosol that is formed during a printing operation. It can be readily appreciated that reducing aerosol formation also helps reduce or altogether eliminate contamination of printer components (e.g., filter 162 in FIG. 2) by excess ink 15 (FIG. 2).

The exemplary embodiments shown and described herein are provided for purposes of illustration and are not intended to be limiting. By way of example, the ink collection and aerosol management systems may be implemented individually or together in a PWA printer. In addition, the ink collection system and aerosol management systems are not limited to the particular configurations shown and described herein.

It is also noted that although a dual-roller configuration is described above with reference to FIG. 2, and a quad-roller configuration is described above with reference to FIG. 3, any number of rollers (one or more) may be implemented in the ink removal and aerosol management systems. Likewise, any number of scrapers (one or more) may be implemented for each roller or plurality of rollers. In addition, the placement of the roller(s) and/or scraper(s) in the housing 101 of the printer system 100 and relative to one another may also be varied depending on design considerations. Exemplary design considerations include, but are not limited to the cost and size of components, throughput, type of ink, and so forth.

Still other embodiments of systems and methods are also contemplated as will be readily appreciated by those having ordinary skill in the art after becoming familiar with the teachings herein.

The invention claimed is:

1. A printer system comprising:

a print head positioned over a platen, the print head to dispense ink during a printing operation;

a roller positioned beneath openings formed in the platen to collect excess ink from the print head directed through the openings onto the roller; and a scraper positioned against the roller to remove ink from the roller.

2. The printer system of claim 1, further comprising an aerosol management system in the platen, the aerosol management system including a plurality of rollers in the platen and corresponding scrapers provided in the platen for each opening in the platen.

3. The printer system of claim 1, wherein the roller rotates during operation to collect the excess ink at or near a top portion of the roller.

4. The printer system of claim 3, wherein the scraper includes a stationary scraper, the stationary scraper removing ink as the roller rotates against the stationary scraper.

5. The printer system of claim 1, wherein the platen is positioned between the print head and the roller, the platen having an opening formed through the platen so that the excess ink drops through the opening.

6. The printer system of claim 1, further comprising an opening formed beneath the print head and aligned with the nozzles in the print head.

7. The printer system of claim 1, wherein a roller is positioned beneath each opening formed beneath the print head.

8. The printer system of claim 7, wherein each roller is aligned with a corresponding die in the print head.

9. The printer system of claim 1, wherein the print head is a page wide array print head.

10. The printer system of claim 1, further comprising a chimney positioning beneath the openings in the platen to direct excess ink onto the roller.

11. The printer system of claim 1, further comprising a blower device to direct excess ink onto the roller under pull of a vacuum.

12. The printer system of claim 1, further comprising dual rollers to move ink on the dual rollers away from each other toward separate scrapers.

13. The printer system of claim 1, further comprising a spring to tension the scraper against the roller.

14. A printer, comprising:

a print head for dispensing ink during a printing operation;

an ink collection system positioned beneath a platen to collect excess ink from the print head dropping through openings in the platen during the printing operation; and an aerosol management system to reduce aerosol formation caused by the excess ink being under vacuum during the printing operation.

15. The printer of claim 14, wherein the aerosol management system is provided in the platen.

16. The printer of claim 15, wherein the aerosol management system includes a plurality of rollers and corresponding scrapers each provided in the platen for each opening of the platen.

17. The printer of claim 14, wherein the ink collection system includes a roller and a scraper positioned against the roller, the scraper removing the excess ink from the roller during rotation of the roller.

18. A printer with ink collection and aerosol management, the printer comprising:

a print head for dispensing ink during a printing operation, the printing operation resulting in at least some overspray of excess ink;

a platen provided beneath the print head, the platen having openings aligned with print dies in the print head;

an aerosol management system provided in the platen, the aerosol management system reducing aerosol formation when a vacuum is applied during the printing operation; and an ink collection system positioned below the aerosol management system to collect excess ink that is not collected by the aerosol management system during the printing operation.

19. The printer of claim 18, wherein the aerosol management system includes a plurality of rollers and corresponding scrapers.

20. The printer of claim 18, wherein the ink collection system includes a roller and corresponding scraper.

* * * * *